United States Patent [19]

Dreher

[11] 4,036,437

[45] July 19, 1977

[54] APPARATUS WITH REVERSING LINEAR TRAVERSE MECHANISM FOR SPRAYING MATERIAL

[75] Inventor: Alfred J. Dreher, Pasadena, Calif.

[73] Assignee: Alfred J. Dreher, Padadena, Calif.

[21] Appl. No.: 658,890

[22] Filed: Feb. 18, 1976

[51] Int. Cl.[2] ..... B05B 3/18

[52] U.S. Cl. ..... 239/186; 51/429

[58] Field of Search ..... 239/184, 186, 187; 51/8 C, 9 R, 9 M; 118/305, 323

[56] References Cited

U.S. PATENT DOCUMENTS

| | | | |
|---|---|---|---|
| 60,386 | 12/1866 | Kirk et al. | 239/186 |
| 260,993 | 7/1882 | Kitsee | 239/186 X |
| 3,041,999 | 7/1962 | Bagshaw | 239/186 X |
| 3,298,352 | 1/1967 | Urablik | 118/305 X |
| 3,383,046 | 12/1968 | Voegtly | 239/186 |
| 3,478,720 | 11/1969 | Bok | 118/323 |
| 3,827,187 | 8/1974 | Yamamoto et al. | 51/9 R |
| 3,916,568 | 11/1975 | Rose et al. | 51/9 M X |

FOREIGN PATENT DOCUMENTS

| | | | |
|---|---|---|---|
| 515,831 | 8/1955 | Canada | 118/305 |

*Primary Examiner*—John J. Love

*Attorney, Agent, or Firm*—Fulwider, Patton, Rieber, Lee & Utecht

[57] ABSTRACT

A grit-blasting or liquid-spraying machine in which a nozzle is reciprocated at a substantially constant linear speed in a direction transverse to a primary direction of travel of the machine, thereby providing substantially uniform coverage of a surface to be treated. The nozzle is carried on a transversely movable supporting block which is secured to a sliding nut which, in turn, is engaged on a rotating shaft and reciprocates back and forth with substantially no slowing at the ends of each stroke. In a grit-blasting embodiment of the machine, the nozzle is also angularly oscillated in a direction parallel to the primary direction of travel, to further increase the uniformity of coverage. In a disclosed paint-spraying embodiment, the machine is advanced in the primary direction of travel only during return transverse strokes of the nozzle, when paint flow is temporarily terminated. Multiple paint-spraying or grit-blasting machines can be coupled together for wider surface coverage.

23 Claims, 10 Drawing Figures

APPARATUS WITH REVERSING LINEAR TRAVERSE MECHANISM FOR SPRAYING MATERIAL

BACKGROUND OF THE INVENTION

This invention relates generally to machines for producing a reciprocating spray of material, and, more particularly, to machines of this general type used for treating a surface by blasting with an abrasive material, or by spraying with paint or a chemical cleaning agent.

In most operations in which a surface is to be treated by blasting with an abrasive grit material such as sand or metal particles, it is usually an objective to treat the surface to be blasted as uniformly as possible. Uniformity of treatment is increased if exposure to the abrasive blast is automatically controlled, and various reciprocating mechanisms have been used in grit-blasting apparatus of the prior art. However, prior attempts to provide means for reciprocating the blast nozzle in a uniform fashion have involved the use of multiple or reversible drive motors or reversible jacks. Inevitably, such reversible devices have inherently high inertia, which results in a relatively long reversal time, and consequent slowing of the nozzle travel at the end of each stroke. Moreover, grit-blasting machines of the prior art are typically very heavy and cumbersome, and are not usable at all in some environments where access is difficult or where a structure to be treated cannot support heavy loads. Similar problems exist in automatic spray-painting or chemical treatment machines which utilize a reciprocating nozzle in an attempt to provide uniform coverage of the paint or other liquid. Use of reciprocating mechanisms of the prior art usually involves substantial slowing of the movement of the nozzle at the end of each stroke, resulting in corresponding increases in exposure to the spray at these times, and consequent non-uniformity in coverage.

Another important disadvantage of both grit-blasting and paint-spraying machines of the prior art is that they present serious problems of air pollution, especially in the immediate area of their use. Although some large grit-blasting machines include some means for recovering the grit material, the relatively large weight and size of these machines precludes their use in some areas, for example in some parts of a ship, or on floating roofs of oil storage tanks.

Pollution by paint-spraying machines is also a significant problem. Moreover, there can be a substantial paint loss in windy conditions, as well as a resulting unevenness in paint coverage.

Accordingly, there is a significant need both in the grit-blasting and liquid-spraying fields for a machine with an automatically reversing mechanism which overcomes the foregoing disadvantages, and achieves substantial uniformity of coverage by the grit or spray, while also substantially reducing environmental pollution. The present invention is principally directed to these ends.

SUMMARY OF THE INVENTION

The present invention is embodied in apparatus for producing a reciprocating spray of material using a reversing linear traverse mechanism to reciprocate a nozzle at a substantially constant speed, with practically instantaneous reversals of movement, and without a reversal of the direction of rotation of a drive motor powering the mechanism. Briefly, and in general terms, the apparatus of the present invention includes a carriage movable in a primary direction of travel across a target surface to be sprayed, a shaft rotatably mounted on the carriage and aligned in a direction transverse to the primary direction of travel, drive means for rotating the shaft, a nozzle for spraying the material against the target surface, and nozzle support means connected to the shaft and supporting the nozzle for motion in the transverse direction. The nozzle support means cooperates with the shaft to reciprocate the nozzle means in the transverse direction without reversal of the direction of rotation of the shaft and the drive means.

The carriage of the presently preferred embodiment includes a hood over the nozzle and over a section of surface area to be treated by the spray. A flexible skirt around the hood prevents the escape of most of the sprayed material to the surrounding atmosphere, thereby significantly reducing atmospheric pollution. Sealing means are also provided to prevent escape of the sprayed material around the nozzle support means.

More specifically, in the presently preferred embodiment of the invention, the shaft is grooved with two oppositely directed spiral camming threads, and the nozzle support means for reciprocating the nozzle includes a commercially available reversing nut mounted on the shaft, and a plurality of camming pins selectively engageable with the shaft threads to produce linear motion of the nut in a desired direction on rotation of the shaft. Sealing means are provided to prevent sprayed material and other contaminants from coming into contact with the camming threads and the reversing nut.

As it relates to a grit-blasting machine, the present invention may also include additional means for angularly oscillating the nozzle in the primary direction of travel, to further increase the uniformity of coverage provided in the blasting operation. When this feature is employed, the path of the nozzle can be seen to be a zigzag motion resulting from movement in the primary direction of travel combined with the transverse reciprocating movement, this motion being further modified by the angularly oscillating movement in the primary direction of travel. In the presently preferred embodiment of the invention, the oscillation in the primary direction of travel is provided by eccentric drive means mounted on the nozzle support means and driven by rack and pinion gearing responsive to transverse movement of the nozzle support means.

Preferably, as in the illustrative embodiment, the drive means for rotating the shaft includes an air-driven motor, and the abrasive material used as a grit is reclaimed from the surrounding hood by conventional means. Use of an air motor as the drive means allows the speed of the traversing device to be conveniently regulated by the air supply pressure. As is conventional, the blast pattern can be regulated by the size of the nozzle, the grit medium and the air pressure. Variation of these parameters together with the traversing speed allows for positive control of the blasting operation and provides for any desired degree of abrasion of the surface being treated.

In a disclosed embodiment of the invention utilized in spray painting, the apparatus also includes a second drive means for advancing the carriage in the primary direction of travel, and means for actuating the second drive means during a return transverse stroke of the nozzle. Also included are means for shutting off the spray during the return stroke, so that the surface being sprayed is exposed to a succession of parallel strokes of the nozzle in a transverse direction, the spray being turned off during the reverse stroke while the carriage is advanced. Again, a practically constant velocity of the nozzle to the ends of the stroke results in substantially uniform spraying coverage.

In accordance with another aspect of the invention, a plurality of the grit-blasting or spray-painting units may be coupled together with their shafts essentially collinear, so that a wide surface area may be covered more rapidly.

It will be appreciated from the foregoing that the present invention provides for a more uniform coverage from a reciprocating spray utilized in grit blasting, spray painting or chemical cleaning. Because the apparatus of the present invention may be made relatively small and light, it can be utilized in environments requiring access through manholes of limited size. Moreover, because the reversing mechanism and the entire blasting or spraying apparatus is relatively light in weight, it can be used on cone roofs or floating roofs of oil or chemical storage tanks.

In the spray-painting unit, the rapid rate of reversal of motion is particularly important in avoiding build-up of a greater thickness of paint at each end of the stroke, as could occur in older, high-inertia machines in which there was a significant slowing down in the region approaching the end of each stroke of transverse travel.

Other aspects and advantages of the present invention will become apparent from the following detailed description, taken in conjunction with the accompanying drawings.

DESCRIPTION OF THE PREFERRED EMBODIMENTS

Figure 8:
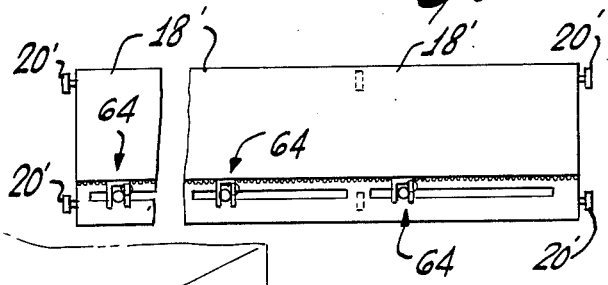
FIG. 8 is a simplified plan view showing a plurality of paint-spraying machines connected together for operation in unison.
Figure 9:
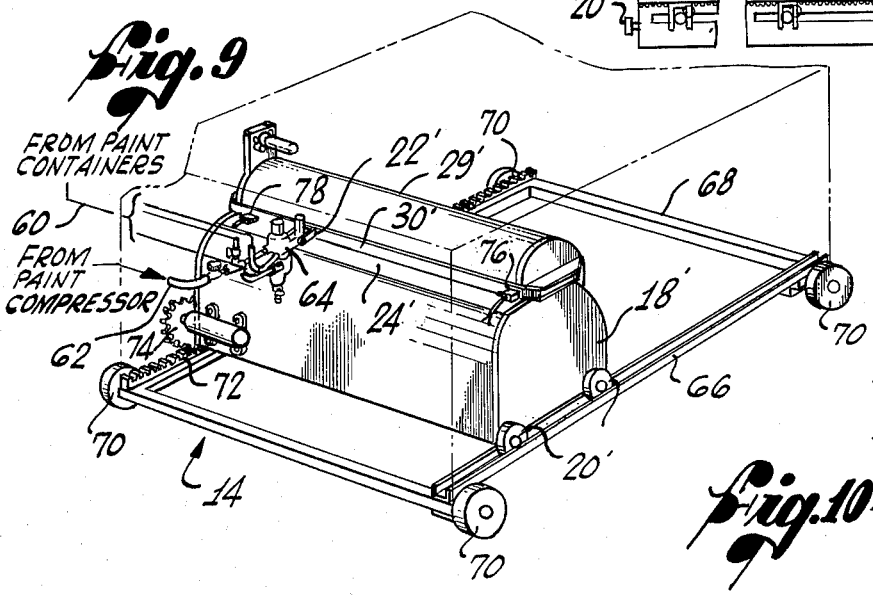
FIG. 9 is a perspective view of a paint-spraying machine embodying the present invention.
Figure 10:
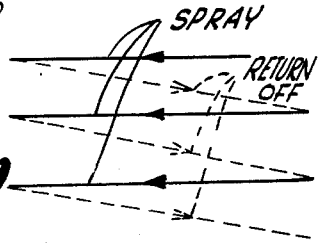
FIG. 10 is a diagrammatic representation of the path of the nozzle of the machine of FIG. 9.

As shown in the drawings for purposes of illustration, the present invention is embodied in a grit-blasting machine, indicated generally by reference numeral 12 and illustrated in FIGS. 1–6, and in an automatic paint-spraying machine 14 illustrated in FIGS. 8–10. It will be understood that the invention is not limited to the blasting of sand or metal grit as the abrasive material, nor to the spraying of paint, but may be used for spraying other flowable materials in appropriate applications. The grit-blasting machine 12 includes a nozzle 6 (see FIG. 5) from which the sand or grit is ejected under pressure, and a hood 18 covering the immediate surface area to be treated.

In accordance with the present invention, the machine 12 is linearly movable in a primary direction of travel on a plurality of wheels 20 (FIG. 1), and the nozzle 16 is reciprocated horizontally in a transverse direction with respect to the primary direction of travel, the reciprocation being at a substantially constant speed, with practically instantaneous reversals of motion and without reversal of any drive motor.

The nozzle 16 is mounted on a horizontal nozzle-supporting block 22 extending in the primary direction of travel and is secured on its undersurface to a transversely extending belt 24. The belt 24 is supported on its underside by a flat, transversely extending ledge 25 (FIG. 5), formed in the hood 18, which has a central transversely extending slot 26 through which the nozzle 16 projects downwardly into the interior of the hood. As will be described hereafter, the block 22 is moved transversely back and forth to move the nozzle 16 along the slot 26 from one end to the other in a reciprocating path, and the function of the belt 24 is to overlap the edges of the slot and prevent escape of material through the slot into the surrounding atmosphere, thereby reducing air pollution in grit-blasting operations. Escape of material from the hood 18 is further reduced by the inclusion of a flexible but relatively stiff skirt 27, which may be of natural or synthetic rubber material, extending around the entire lower periphery of the hood and engaging the surface to be grit-blasted.

The belt 24 passes over a plurality of pulleys 28 (FIG. 1) mounted on the hood 18. Upper and lower parallel portions of the belt 24 pass across the top of the hood 18, and the nozzle-supporting block 22 is secured to the upper side of the lower portion of the belt.

Figure 4:
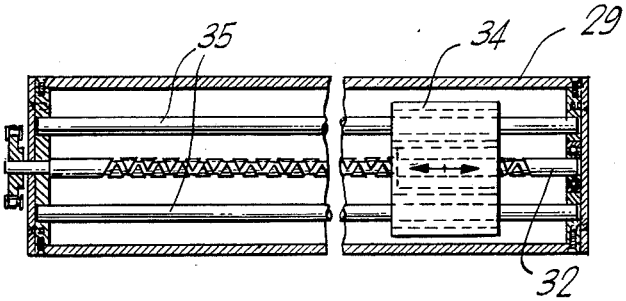
FIG. 4 is a simplified sectional view of the reversing mechanism utilized in the present invention.
Figure 5:
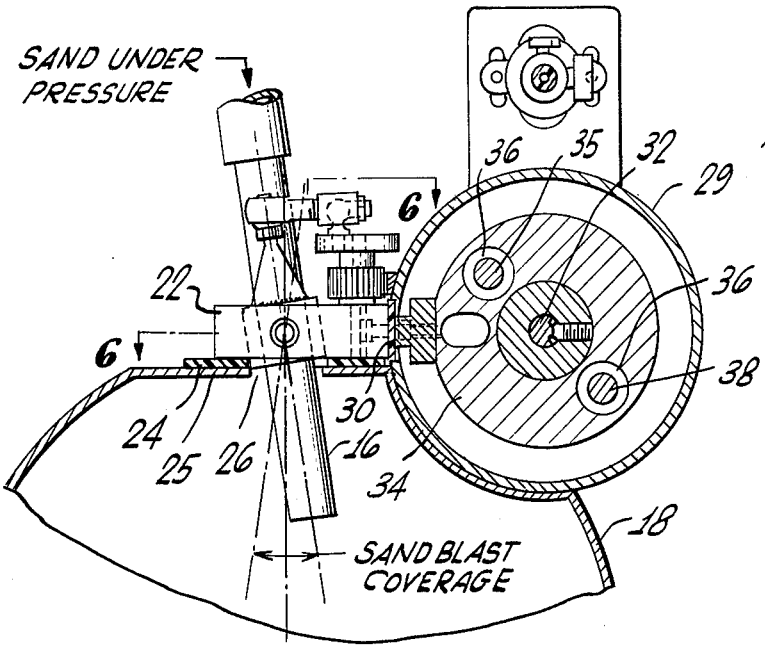
FIG. 5 is a fragmentary, partly sectioned end-elevational view of the machine of FIG. 1, showing the traverse reversing mechanism and the mechanism for oscillating the nozzle in the primary direction of motion.
Figure 6:
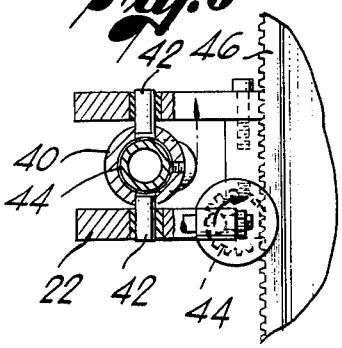
FIG. 6 is a sectional view taken substantially along the line 6—6 of FIG. 5.

Mounted on the hood 18 is a horizontal cylindrical housing 29 with its longitudinal axis aligned substantially perpendicularly to the primary direction of travel, i.e., parallel to the axes of the wheels 20. The cylindrical housing 29 encloses a reversing traverse mechanism, illustrated in FIG. 4, and also has an endless belt 30 (FIG. 3) running in a longitudinal direction along its cylindrical walls and substantially diametrically across its ends. The belt 30 covers a longitudinal opening in the cylindrical housing 29 along its cylindrical wall nearest the nozzle-supporting block 22. As best shown in FIGS. 4 and 5, the cylindrical housing 29 supports a central shaft 32, the rotation of which produces reciprocating motion in a sliding nut 34 engaged on the shaft. To stabilize the nut 34 so that it does not turn with the shaft 32, two horizontal, stationary slider bars 35 are mounted within the housing 28, secured to its opposite ends, and pass slideably through two sleeve bearings 36 mounted in the nut 34.

The shaft 32 has two spiral camming threads cut in opposite directions, resulting in a thread sometimes known as a "diamond thread". The sliding nut 34 contains a system of rollers (not shown) which engage one at a time of the two camming threads on the shaft 32, and cause translation of the nut in one direction along the shaft as the shaft is rotated. When the nut 34 reaches the end of its travel on the shaft 32, the internal arrangement of the rollers or pins within the nut is changed by a camming surface at the end of the shaft, and the nut is immediately reversed in its direction of translation, the rollers engaging in the opposite camming threads for the reverse motion. This type of shaft and nut assembly is available commercially under the name of "Rollnut", from Norco, Inc., Box 405, Georgetown, Connecticut 06829. The basic mechanism is also disclosed in U.S. Pat. No. 3,779,094, issued in the name of LaBarre, and the pertinent description in that patent is incorporated herein by reference.

Figure 1:
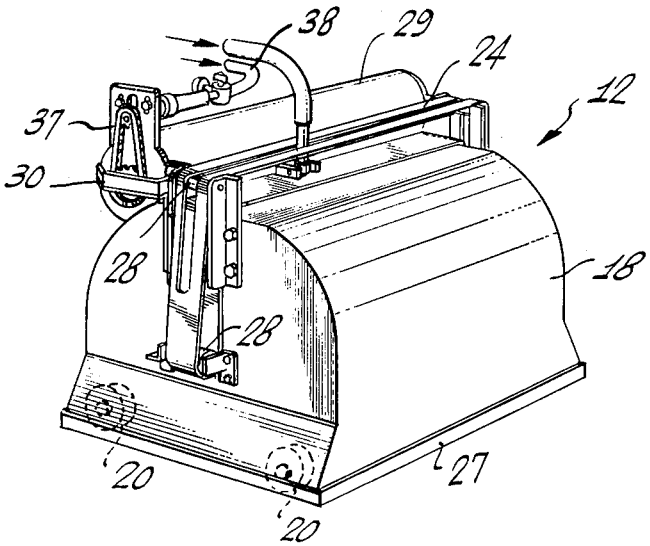
FIG. 1 is a perspective view of a grit-blasting machine embodying the present invention.
Figure 2:
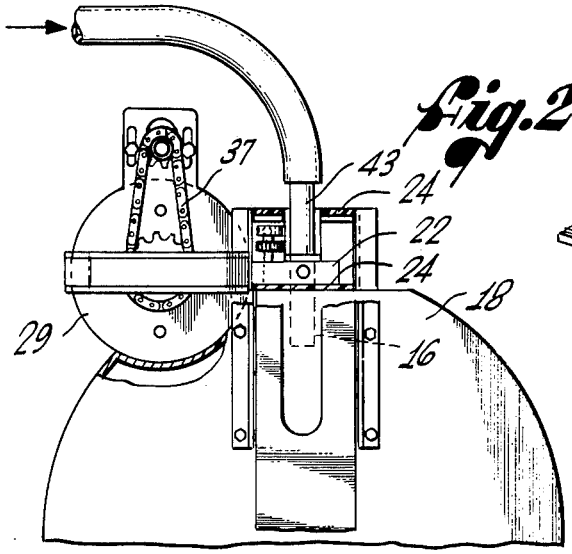
FIG. 2 is an enlarged, fragmentary, end-elevational view of the machine of FIG. 1.

As best shown in FIG. 5, the nozzle-supporting block 22 is secured to the sliding nut 34. The block extends through and is connected to the belt 30 which passes around the cylindrical housing 29. The purpose of the belt 30 is to exclude unwanted dust and other harmful matter from the reversing mechanism enclosed within the housing 29. The shaft 32 is rotated by means of a chain drive 37 driven by an air motor which is supplied with air through line 38 (FIG. 1). It will be appreciated from the description thusfar that, as the shaft 32 is rotated, the nozzle-supporting block 22 will be reciprocated back and forth across the hood 18 of the machine 12.

Figure 3:
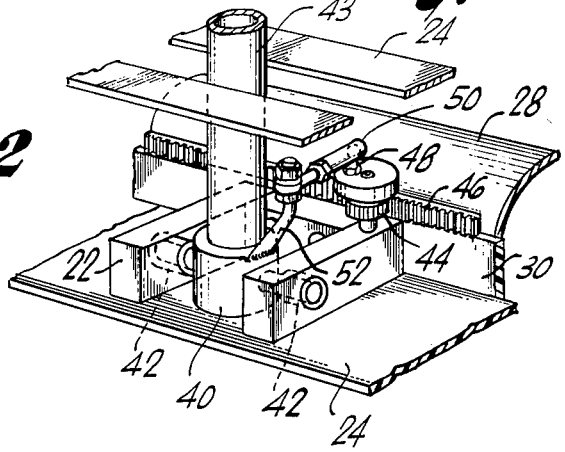
FIG. 3 is a further enlarged, fragmentary, perspective view showing how the grit-blasting nozzle is oscillated in the primary direction of travel.

As best shown in FIGS. 3 and 5, the nozzle-supporting block 22 is generally U-shaped, and the nozzle 16 is supported in the block 22 for pivotal movement about a horizontal axis parallel with the transverse reciprocating movement of the nozzle. More particularly, the nozzle 16 has attached to it a collar 40 to which are attached a pair of outwardly projecting pins 42 which are journaled in the side members of the U-shaped block 22. As can be seen in FIGS. 1 and 3, the nozzle 16 is supplied with metallic grit or other abrasive particulate material through a pipe 43 which projects upwardly from the collar 40 through a longitudinal slot in the upper portion of the belt 24 and is connected to an appropriate supply hose.

Figure 7:
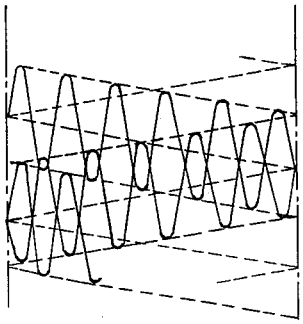
FIG. 7 is a diagrammatic representation of the path of the nozzle of the grit-blasting machine illustrated in FIGS. 1–6.

Mounted for rotation on the block 22 about a vertical axis is a pinion 44 which engages a transversely extending toothed rack 46 attached to the housing 29 immediately above the belt 30. Affixed to the upper surface of the pinion 44 is an upstanding eccentric pivot post 48 to which is pivotally coupled a horizontal connecting rod 50 extending towards the nozzle. The other end of the connecting rod 50 is connected to a generally vertical arm 52 which, in turn, is rigidly attached to the collar 40. It will be seen that, as the block 22 and nozzle 16 are translated tranversely along the housing 29, the pinion 44 will provide an oscillating motion through the connecting rod 50 to the collar 40, and hence provide an angularly oscillating motion to the nozzle 16 about the bearing pins 42. The resultant path of the nozzle is shown diagrammatically in FIG. 7. The reciprocating movement provided by the mechanism of the shaft 32 and sliding nut 34 produces a zigzag path when combined with the primary direction of travel on the wheels 20. This is combined with the further oscillating motion provided by the eccentric pivot 48 applied to the nozzle 16, and results in substantially uniform coverage of the surface to be treated.

FIG. 9 is a perspective view of a paint-spraying machine 14 employing the same principles as described in connection with the grit-blasting machine 12. Again, a hood 18' is provided, and a cylindrical housing 29' is mounted on the top of the hood to enclose a self-reversing reciprocating mechanism similar to the one described above in connection with the grit-blasting machine 12. The hood reduces wind dissipation of the paint being sprayed during open air operations thereby avoiding a serious disadvantage of various prior spray painting methods. The paint-spraying machine also includes endless belts 24' and 30', similar to the previously described belts 24 and 30 of the grit-blasting machine, to reduce escape of paint into the atmosphere and cut down pollution and waste.

The paint-spraying machine includes a downwardly directed conventional paint spraying nozzle assembly which is supplied with paint through lines 60 and with compressed air through lines 62, which connect to the spray nozzle above, and outside of, the belt 24'. The spray nozzle itself projects below the belt 24' into the interior of the hood and towards the surface to be sprayed. Also included is a transversly movable nozzle supporting block 22' which is reciprocated back and forth across the hood 18' in a transverse direction with respect to the primary direction of motion on the wheels 20'. The block 22' is generally similar to the block 22 used in the grit-blasting machine, but with the difference that the nozzle is fixedly secured to the arms of the block in a vertical, downward facing relation and is not mounted for oscillating motion about a horizontal transverse axis. Further, unlike the grit-blasting machine, the paint-spraying machine 14 has no rack and pinion mechanism for oscillating the nozzle.

In the paint-spraying machine illustrated, the wheels 20' are mounted in channels 66 on a rectangular frame 68, (FIG. 9) which is itself mounted on other wheels 70 for purposes of movement of the entire assembly. Along one side of the frame 68 is a rack gear 72 which engages with a corresponding pinion 74 mounted on a horizontal axis on the hood 18'. The pinion 74 is also driven by an air motor (not shown), and allows the apparatus to be advanced in steps in the primary direction of travel along the frame 68.

An electrical switch, shown at 76, is located at one end of the stroke of the carriage 64, and is coupled by conventional electrical means to activate the air motor driving the pinion 74, and simultaneously to cut off the supply of paint to the machine 14. Another switch 78, located at the other end of the stroke of the carriage 64, is electrically coupled to deactivate the air motor driving the pinion 74, and simultaneously to reinitiate the supply of paint. Thus paint is sprayed while the vehicle is stationary as the nozzle is moving transversely in one direction, and spraying is terminated while the vehicle is moving and the nozzle is returning in the opposite transverse direction. It will be seen that this results in a spraying pattern substantially similar to the one illustrated in FIG. 10., i.e., the pattern will consist of a series of parallel bands, with the hood 18' and accompanying nozzle being advanced in the primary direction of travel only when the paint spray is turned off. The substantially uniform speed of reciprocation results in an extremely uniform distribution of paint and avoids the build-up in paint thickness near the ends of transverse travel associated with various prior recprocating sprayers which slow significantly at the ends of each stroke.

As shown in simplified form in FIG. 8, a number of paint-spraying units comprising the hood 18', cylindrical housing 29' and carriage 64, could be coupled in tandem to provide a wider area of coverage than could be obtained with a single unit. The mechanisms enclosed in the cylindrical housings 29' could, if desired, be coupled to a common shaft and common drive motor to operate the multiple units in unison. A similar arrangement could be utilized with the grit-blasing embodiment already described.

It will be appreciated from the foregoing that the present invention represents a significant advance both in the grit-blasing and the spray-painting fields. In particular, the invention provides the means for reciprocating a nozzle at a substantially uniform speed with practically no slowing at the ends of the stroke, and thereby provides for a substantially uniform coverage or exposure to the material being blasted or sprayed. Furthermore, the invention is substantially non-polluting, is relatively small and light in weight, and can be easily adapted for a wide variety of blasting and spraying uses. It will also be appreciated that, although particular forms of the invention have been described in detail for purposes of illustration, various modifications may be made without departing from the spirit and scope of the invention. Accordingly, the invention is not be limited except as by the appended claims.

I claim:

1. A machine for directing a spray of material across a target surface, said machine having a carriage movable in a first direction across the target surface and nozzle means supported in the carriage, for spraying the material against the target surface, wherein the improvement comprises:

a shaft rotatably mounted in said carriage, having oppositely directed spiral camming threads thereon, and aligned in a second direction substantially perpendicular to said first direction in generally parallel relation to said target surface;

drive means for rotating said shaft;

a sliding nut for engaging one at a time of said spiral camming threads, with means for automatically engaging alternate ones of said camming threads at opposite extremes of travel of said nut on said shaft, to convert rotational motion of said shaft to linear reciprocating motion of said nut at a substantially constant speed;

a housing for said shaft and said nut, including means engaging said nut to maintain alignment thereof and prevent rotation thereof on said shaft; and carrier means connecting said nut to said nozzle means, including sealing means to exclude harmful material from said housing;

whereby said nozzle means is reciprocated linearly in said second direction without drive reversal or unnecessary dwell at the ends of its travel, and said shaft, nut and housing can withstand transient mechanical stresses imposed by the spraying of some materials.

2. A machine as set forth in claim 1, wherein said sealing means includes an endless belt covering a longitudinal slot in said housing.

3. A machine as set forth in claim 1, said improvement further including means for angularly oscillating said nozzle means in a direction substantially parallel to said first direction.

4. A machine as set forth in claim 1, wherein:

said nozzle means is mounted in said carrier means for pivotal motion about an axis parallel with said second direction; and said machine further includes oscillating means connected to said nozzle means for angularly oscillating said nozzle means about said axis.

5. A machine as set forth in claim 1, said improvement further including hood means enclosing said nozzle means and covering a section of the target surface, to reduce atmospheric pollution by the sprayed material.

6. A machine as set forth in claim 5, said improvement further including a skirt flexibly mounted to the lower periphery of said hood means to reduce loss of the sprayed material from beneath said hood means.

7. A machine as set forth in claim 5, wherein:

said hood means has an elongated slot therein extending in the second direction;

said nozzle means has a portion extending through said slot and is reciprocated back and forth along said slot; and said nozzle support means includes sealing means for inhibiting the escape of material from said hood means through said slot.

8. A machine as set forth in claim 7, wherein said sealing means includes a continuous belt in part overlying said slot and interposed between said nozzle support means and said hood means.

9. A machine as set forth in claim 1, wherein said machine is utilized as a liquid sprayer and said improvement further includes:

intermittently actuated second drive means coupled to advance said carriage in said first direction in steps; and switch means mounted on said carriage and operable by said nozzle support means to actuate said second drive means and simultaneously to cut off supply of liquid during a return stroke of said nozzle support means;

whereby the liquid is sprayed in a succession of parallel and contiguous bands on the target surface.

10. A machine a set forth in claim 9, wherein said switch means includes:

a first switch mounted on said carriage in such a location as to be actuated at the beginning of the return stroke, said first switch being coupled to cut off the supply of liquid and to activate said second drive means; and a second switch mounted on said carriage in such a location as to be actuated at the end of the return stroke, said second switch being coupled to reinitiate the supply of liquid and to deactivate said second drive means.

11. A machine as set forth in claim 9, said improvement further including means for coupling said machine to similar machines arranged in a substantially straight line in said second direction, to provide for wider coverage of the target surface.

12. A grit-blasting machine providing substantially uniform coverage of a target surface, said machine comprising:

a carriage movable linearly in a primary direction of travel across the target surface;

a shaft rotatably mounted on said carriage, having two oppositely directed spiral camming grooves thereon, and aligned in a transverse direction with respect to said primary direction of travel;

drive means for rotating said shaft;

a nozzle for spraying grit material under pressure onto the target surface;

nozzle support means movable in said transverse direction with respect to said carriage, and including means for pivotally mounting said nozzle to allow angular oscillation of said nozzle about an axis substantially parallel with said transverse direction;

mechanical means attached to said nozzle support means and engaging said shaft, to reciprocate said nozzle support means in said transverse direction without reversal of the direction of rotation of said shaft and said drive means, said mechanical means including a sliding nut with means for engaging alternate ones of said camming grooves to convert rotational motion of said shaft to linearly reciprocating motion of said nut, a housing for said shaft and said nut, means affixed in said housing and engaging said nut to prevent rotation thereof, and means connecting said nut to said nozzle support means, including sealing means to exclude harmful material from said housing; and means responsive to transverse movement of said nozzle support means, for angularly oscillating said nozzle;

whereby said nozzle is reciprocated transversely at a substantially constant speed, with practically instantaneous reversals of movement, and is simultaneously angularly oscillated and advanced linearly in said primary direction of travel.

13. A grit-blasting machine comprising:

a carriage movable in a first direction across a target surface to be grit-blasted;

a shaft rotatably mounted in said carriage, and aligned in a second direction substantially perpendicular to said first direction in generally parallel relation to the target surface, said shaft having oppositely directed spiral camming threads thereon;

drive means for rotating said shaft;

nozzle means for spraying the grit against the target surface; and nozzle support means connected to said shaft and supporting said nozzle means for motion relative to said carriage in the second direction, said nozzle support means including a sliding nut having means for automatically engaging alternate ones of said camming threads to convert rotational motion of said shaft to linearly reciprocating motion of said sliding nut and said nozzle means, a rigid housing enclosing said shaft and said nut, means affixed in said housing and engaging said nut to prevent rotation thereof, and means connecting said nut to said nozzle means and including sealing means to prevent entry of unwanted matter into said housing.

14. A grit-blasting machine as set forth in claim 13, and further including:

hood means enclosing said nozzle means and covering a section of the target surface; and a peripheral skirt attached to said hood means and engaging the target surface to inhibit the escape of blasted grit material.

15. A grit blasting machine as set forth in claim 14 wherein:

said hood means has an elongated slot therein extending in the second direction;

said nozzle means extends through said slot and is reciprocated along said slot; and said nozzle support means includes sealing means for inhibiting the escape of grit material from said hood means through said slot.

16. A grit-blasting machine as set forth in claim 13, wherein said sealing means includes an endless belt covering a longitudinal slot in said housing.

17. A paint-spraying maching comprising:

a carriage movable in a first direction across a target surface to be painted;

a shaft rotatably mounted in said carriage, and aligned in a second direction substantially perpendicular to said first direction in generally parallel relation to the target surface, said shaft having oppositely directed spiral camming threads thereon;

drive means for rotating said shaft;

nozzle means for spraying the paint against the target surface; and nozzle support means connected to said shaft and supporting said nozzle means for motion relative to said carriage in the second direction, said nozzle support means including a sliding nut having means for automatically engaging alternate ones of said camming threads to convert rotational motion of said shaft to linearly reciprocating motion of said sliding nut and said nozzle means at a substantially constant speed with practically instantaneous reversals of movement, a rigid housing enclosing said shaft and said nut, means affixed in said housing and engaging said nut to prevent rotation thereof, and means connecting said nut to said nozzle means and including sealing means to prevent entry of unwanted matter into said housing.

18. A paint-spraying machine as set forth in claim 17, and further including hood means enclosing said nozzle means and covering a section of the target surface.

19. A paint-spraying machine as set forth in claim 18, wherein:

said hood means has an elongated slot therein extending in the second direction;

said nozzle means extends through said slot and is reciprocated along said slot; and said nozzle support means includes sealing means for inhibiting the escape of paint spray material through said slot.

20. A paint-spraying machine as set forth in claim 17, wherein said sealing means includes an endless belt covering a longitudinal slot in said housing.

21. A paint-spraying machine as set forth in claim 17, and further including:

means for advancing said carriage in the first direction during a return stroke of said nozzle means in the second direction; and means for temporarily cutting off paint supply to said nozzle means during the return stroke.

22. A machine for directing a spray of material against a target surface, comprising:

a carriage movable in a first direction across the target surface;

a shaft rotatably mounted in said carriage, having oppositely directed spiral camming threads thereon, and aligned in a second direction substantially perpendicular to said first direction in generally parallel relation to the target surface;

drive means for rotating said shaft;

nozzle means for spraying the material against the target surface;

nozzle support means connected to said shaft and supporting said nozzle means for motion relative to said carriage in the second direction, said nozzle support means cooperating with said shaft to reciprocate said nozzle means in said second direction without reversal of rotation of said shaft and said drive means, and said nozzle support means including a sliding nut for engaging one at a time of said spiral camming threads, with means for automatically engaging alternate ones of said camming threads at opposite extremes of travel of said nut on said shaft to convert rotational motion of said shaft to linearly reciprocating motion of said nozzle means, and carrier means for connecting said nut to said nozzle means, said nozzle means being mounted in said carrier means for pivotal motion about an axis parallel with said second direction; and oscillating means connected to said nozzle means for angularly oscillating said nozzle means about said axis, said oscillating means including an eccentric oscillating pivot post mounted on a pinion, a connecting rod coupling said pivot post to the nozzle, and a toothed rack mounted on said carriage and engaging and rotating said pinion, to oscillate said nozzle means in said first direction during reciprocation in said second direction.

23. A grit-blasting machine providing substantially uniform coverage of a target surface, said machine comprising:

a carriage movable linearly in a primary direction of travel across the target surface;

a shaft rotatably mounted on said carriage and aligned in a transverse direction with respect to said primary direction of travel;

drive means for rotating said shaft;

a nozzle for spraying grit material under pressure onto the target surface;

nozzle support means movable in said transverse direction with respect to said carriage, and including means for pivotally mounting said nozzle to allow angular oscillation of said nozzle about an axis substantially parallel with said transverse direction;

mechanical means attached to said nozzle support means and engaging said shaft, to reciprocate said nozzle support means in said transverse direction without reversal of the direction of rotation of said shaft and said drive means; and means responsive to transverse movement of said nozzle support means, for angularly oscillating said nozzle;

whereby said nozzle is reciprocated transversely at a substantially constant speed, with practically instantaneous reversals of movement, and is simultaneously angularly oscillated and advanced linearly in said primary direction of travel; and wherein said means for angularly oscillating said nozzle includes a rack and pinion gear for converting reciprocating motion of said nozzle support means in said transverse direction to rotation of said pinion gear, a pivot post mounted eccentrically on said pinion gear, and a connecting arm linking said pivot post to said nozzle to impart angular reciprocation to said nozzle on rotation of said pinion gear.

* * * * *